US009199267B2

(12) United States Patent
Bandura

(10) Patent No.: US 9,199,267 B2
(45) Date of Patent: Dec. 1, 2015

(54) APPARATUS AND METHOD FOR SPRAY COATING A MATERIAL HANDLING SURFACE

(75) Inventor: John Bandura, Rocky Mountain House (CA)

(73) Assignees: John Bandura, Rocky Mountain House, Alberta (CA); Bernice Bandura, Rocky Mountain House, Alberta (CA)

( * ) Notice: Subject to any disclaimer, the term of this patent is extended or adjusted under 35 U.S.C. 154(b) by 326 days.

(21) Appl. No.: 13/543,603

(22) Filed: Jul. 6, 2012

(65) Prior Publication Data

US 2013/0017336 A1 Jan. 17, 2013

Related U.S. Application Data

(60) Provisional application No. 61/506,565, filed on Jul. 11, 2011.

(51) Int. Cl.

| | |
|---|---|
| ***B05B 15/06*** | (2006.01) |
| ***B05D 1/02*** | (2006.01) |
| ***B05B 9/06*** | (2006.01) |
| ***B05B 3/00*** | (2006.01) |
| ***B05B 7/16*** | (2006.01) |
| ***B05B 9/00*** | (2006.01) |
| ***B05B 9/04*** | (2006.01) |
| ***B05B 13/00*** | (2006.01) |

(52) U.S. Cl.
CPC . *B05D 1/02* (2013.01); *B05B 9/002* (2013.01); *B05B 9/04* (2013.01); *B05B 13/005* (2013.01)

(58) Field of Classification Search
CPC ..... B05B 13/005; B05B 9/002
USPC ..... 118/302, 666, 667, 323, 321, 683, 118/695–698; 239/130, 132.1, 124, 135, 239/332, 532, 670, 172, 525, 526; 427/421.1, 427.7
See application file for complete search history.

(56) References Cited

U.S. PATENT DOCUMENTS

| | | | | |
|---|---|---|---|---|
| 3,243,123 | A * | 3/1966 | Inghram et al. | 239/124 |
| 4,387,851 | A * | 6/1983 | Dick | 239/135 |
| 4,423,980 | A * | 1/1984 | Warnock | 404/83 |
| 4,545,940 | A * | 10/1985 | Mutoh et al. | 554/211 |
| 5,908,551 | A * | 6/1999 | Onken | 210/184 |
| 6,315,648 | B1 * | 11/2001 | Neer | 451/92 |
| 6,729,805 | B2 * | 5/2004 | Wathen | 405/263 |

* cited by examiner

*Primary Examiner* — Yewebdar Tadesse
(74) *Attorney, Agent, or Firm* — Troutman Sanders LLP; Ryan A. Schneider

(57) ABSTRACT

An apparatus for spraying an oil, such as an MSDS exempt vegetable oil, onto a material handling surface to impede material from adhering to the surface. The apparatus comprises a platform comprising an elevated section configured to support a human operator, and spray equipment comprising a container for containing the oil, a hydraulic pump fluidly coupled to the container, and a spray wand and hose fluidly coupled to the pump. The spray equipment is mounted on the platform and configured to enable an operator to operate the spray wand from the elevated section of the platform.

18 Claims, 6 Drawing Sheets

APPARATUS AND METHOD FOR SPRAY COATING A MATERIAL HANDLING SURFACE

CROSS REFERENCE TO RELATED APPLICATIONS

This application claims priority of U.S. Provisional Patent Application No. 61/506,565 filed 11 Jul. 2011, the entire contents and substance of which are hereby incorporated by reference.

BACKGROUND OF THE INVENTION

1. Field of the Invention

This invention relates generally to an apparatus and method for spray coating a material handling surface, such as a truck bed, an excavator bucket, a bulldozer blade, a packer wheel, and a loader bucket.

2. Description of Related Art

Conventional approaches to lining truck and trailer units for contamination and/or wet material handling include lining the contact surfaces of these units with polymer plastic liners and/or with beds of straw. There are a number of drawbacks with this approach, including high cost and messiness. Also, such approaches require lengthy times for application, thereby increasing "downtime" of equipment. For example, it can take 20 minutes or more to line a dump truck box with a bed of straw or a plastic sheet liner.

Since a dump truck box tends to be covered with a fresh liner each time it hauls a load, such plastic liners and straw beds also have the drawback of adding substantially to our landfills. Both materials have a negative impact on the environment, with plastic liners requiring a lengthy period to break down, and with straw causing weed growth in landfills.

Further, some jurisdictions, like the Alberta government, have initiatives to reduce the use of plastics and straw in lining waste disposal applications and in some cases may outright ban the use of these types of products in certain applications.

BRIEF SUMMARY OF THE INVENTION

According to one aspect of the invention, there is provided a method of impeding a material from adhering to a material handling surface, wherein the method comprises spraying an oil onto the material handling surface such that the surface is coated with the oil. The oil is exempt from listing in a workplace hazardous material handling data sheet (MSDS) under Health Canada's Workplace Hazardous Materials Information System. Such an oil can be a vegetable oil selected from the group consisting of: sunflower oil, Mazola oil, flax oil, olive oil, coconut oil, corn oil, soy oil, safflower oil, and canola oil. The material handling surface can be a truck bed, a trailer bed, an excavator bucket, a bulldozer blade, a packer wheel, or a loader bucket.

According to another aspect of the invention, there is provided an apparatus for spraying an oil, such as the aforementioned MSDS exempt vegetable oils, onto a material handling surface to impede material from adhering to the surface. The apparatus comprises: a platform comprising an elevated section configured to support a human operator; and spray equipment comprising a container for containing the oil, a hydraulic pump fluidly coupled to the container, and a spray wand and hose assembly fluidly coupled to the pump. The spray equipment is mounted on the platform and configured to enable the operator to operate the spray wand from the elevated section of the platform. The platform can comprise a base section and an equipment enclosure mounted on the base section for enclosing the spray equipment. The base section can also comprise means for coupling to a bed of pick-up truck.

The spray equipment can further comprise an electric heater for heating the interior of the equipment enclosure, as well as a control panel having a power block and fuse panel with a power input terminal and multiple power output terminals at least some of which are coupled to the heater and the pump. The spray equipment can further comprise a battery electrically coupled to the power input terminal.

The elevated section can comprise an operator box suitable for supporting a human operator and located at a height which enables the operator to spray over a top edge of a dump truck box when the apparatus is mounted in a pick-up truck bed. The operator box can comprise clearance lights electrically coupled to the control panel. The operator box can also comprise a pump actuation switch coupled to the pump.

According to another aspect of the invention, there is provided an apparatus for spraying an oil onto a material handling surface to impede material from adhering to the surface comprising: an oil reservoir pressure tank for containing the oil; an anti-freeze conduit extending inside the pressure tank and thermally communicable with oil in the tank, the anti-freeze conduit fluidly coupled to an antifreeze source; an air feed conduit fluidly coupled to an air inlet of the pressure tank and fluidly coupled to an air compressor; and a spray wand and hose assembly fluidly coupled to an oil outlet of the pressure tank and the air compressor. Such an apparatus can be mounted to a motor vehicle like a pick-up truck and utilize the vehicle's air compressor and anti-freeze tank, thereby enabling the apparatus to have a particularly compact design.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
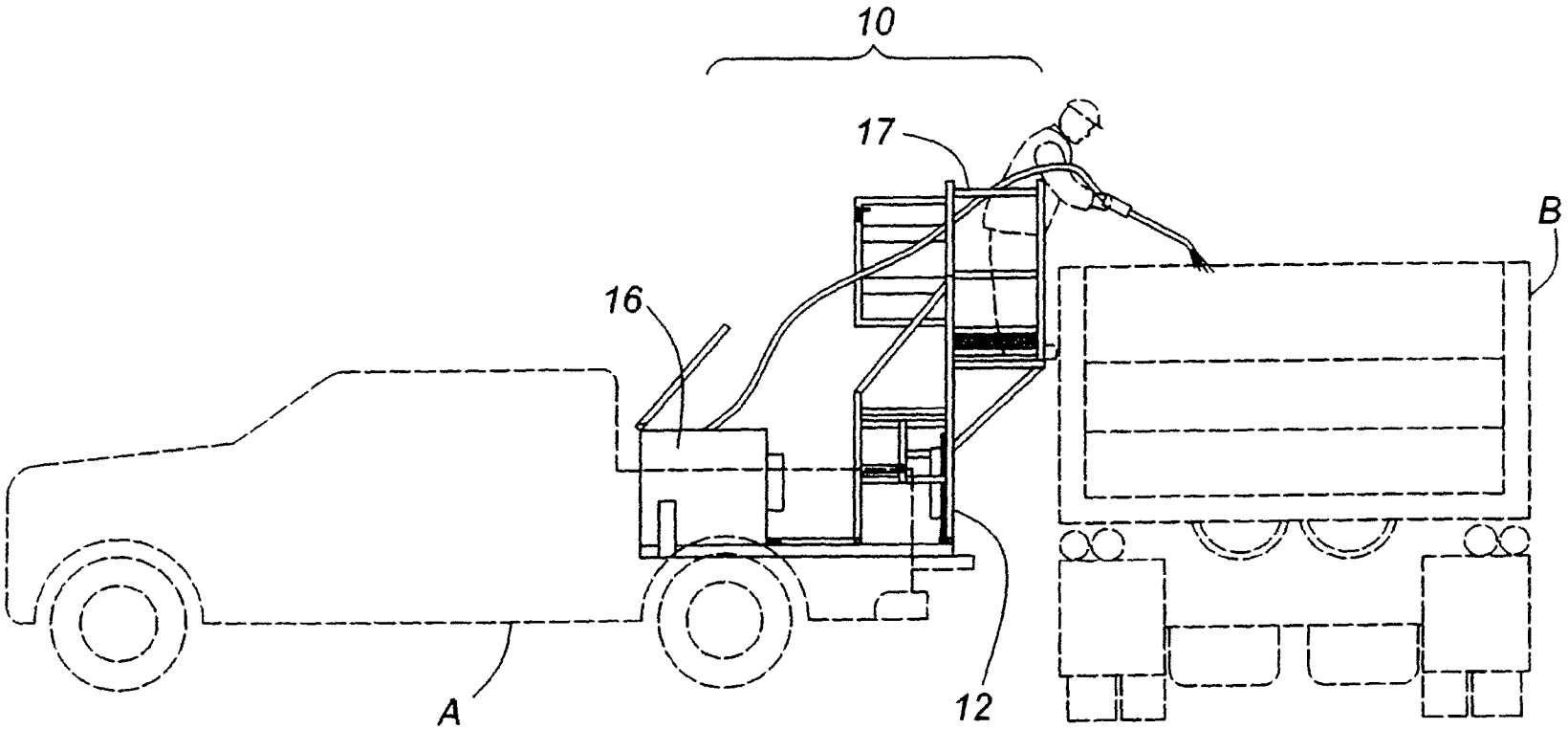
FIG. 1 is a schematic side elevation view of a spray apparatus according to a first embodiment of the invention, mounted to a bed of a pick-up truck, and being used to spray the bed of a dump truck.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

The embodiments described herein relate to a spray apparatus and method for spraying a liquid coating onto a truck bed or other material handling surface to prevent or impede materials from sticking to such surface. The coating described in these embodiments is a vegetable oil based liquid that is exempt from Health Canada's Workplace Hazardous Materials Information System (WHMIS) requirements for material safety data sheets (MSDS) in workplaces, as well as the MSDS listing requirements in other jurisdictions. Suitable such vegetable oils include: sunflower oil, Mazola oil, flax oil, olive oil, coconut oil, corn oil, soy oil, safflower oil, and canola oil. Such oils are not considered to be hazardous materials under the WHMIS MSDS requirements and thus are attractive for use as a surface coating especially in applications where such oils will be released into the environment.

Referring to FIGS. 1 to 5 and according to a first embodiment of the invention, a spray apparatus 10 comprises a platform 12, and spray equipment 14 housed in an equipment enclosure 16 mounted on the platform 12. The apparatus 10 can be made mobile by mounting the platform 12 on a vehicle, such as a bed of a pick-up truck A as shown in FIG. 1. In such configuration, the apparatus 10 can be moved into a convenient position to spray the vegetable oil onto a material handling surface such as bed of a dump truck box B as shown in FIG. 1. The platform 12 has an elevated section 17 which allows an operator to stand in an elevated position to spray the vegetable oil onto the dump truck box bed.

Figure 4:
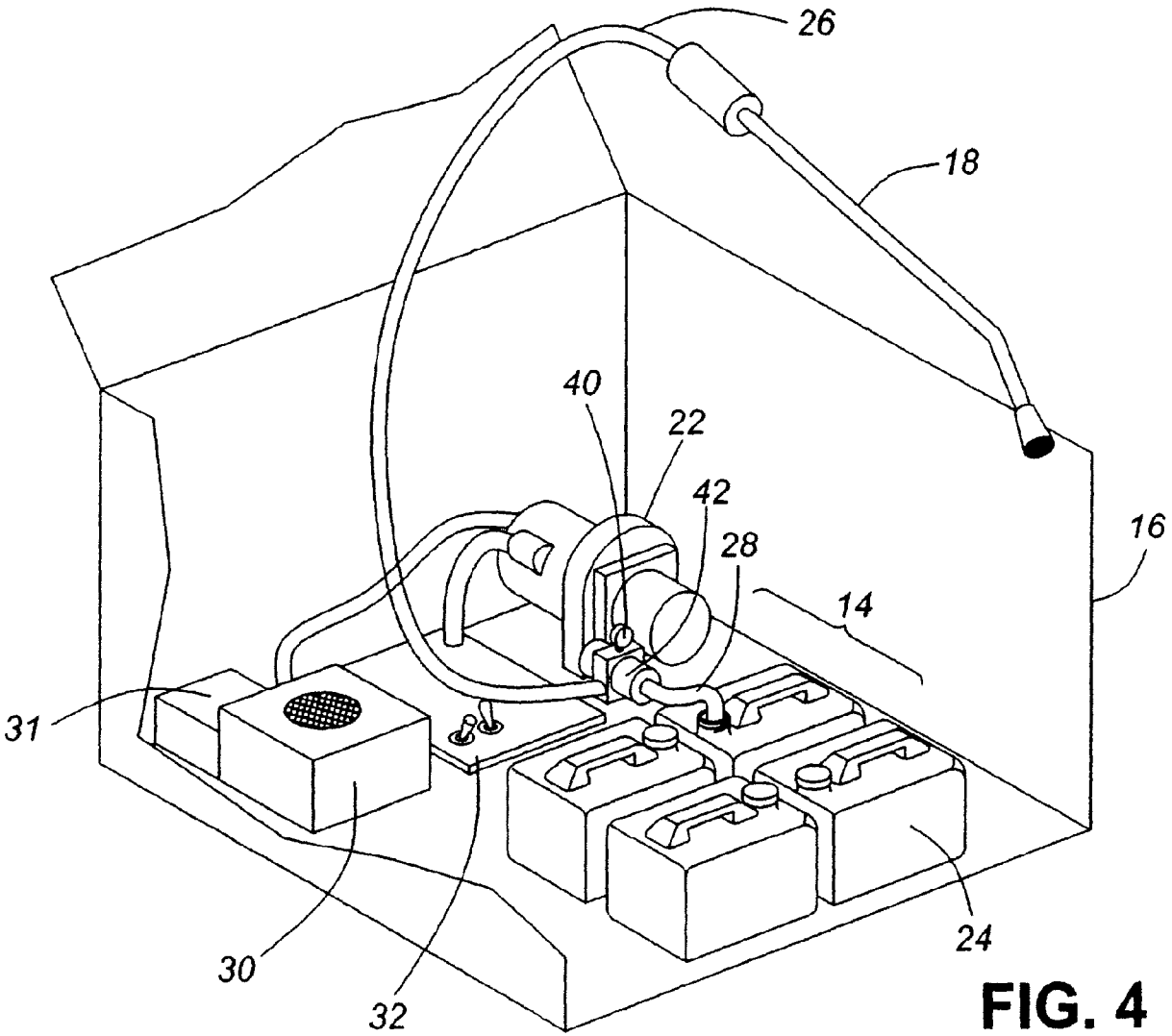
FIG. 4 is a cut-away perspective view of spray equipment in an equipment housing of the spray apparatus.
Figure 5:
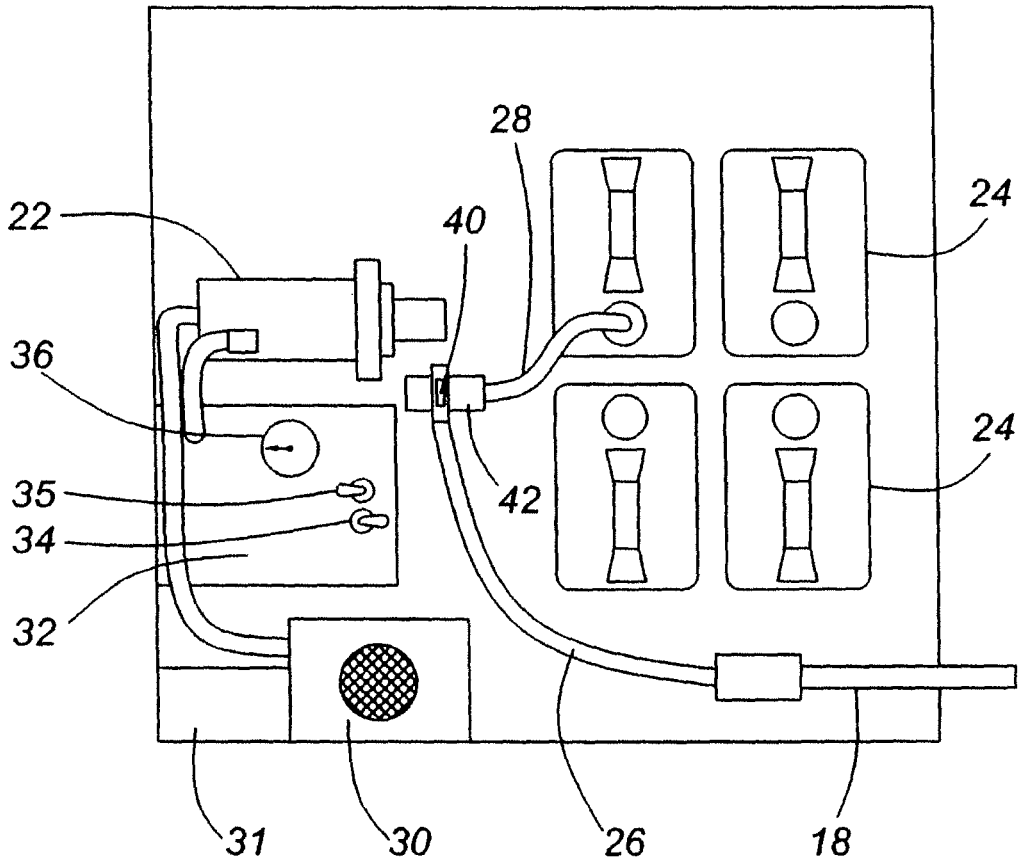
FIG. 5 is a top view of the spray equipment.

Referring to FIGS. 4 and 5, the spray equipment includes a spray wand 18, an electrically powered hydraulic pump 22, multiple oil containers 24 containing vegetable oil, a spray wand feed hose 26 fluidly connecting an outlet of the hydraulic pump 22 to an inlet of the spray wand 18, and a pump feed hose 28 fluidly connecting the oil containers 24 to an inlet of the pump 22. In this embodiment, the pump feed hose 28 is connected to one oil container 24 at a time, and is manually switched to another container 24 when the connected container is emptied. Alternatively, one large container (not shown) can be provided instead of multiple smaller containers, or the pump feed hose 28 can be connected to a manifold (not shown) with several inlets each connected to a container 24 can be provided to remove the need to switch between containers 24.

The spray equipment also includes a thermostat-controlled electric space heater 30, a battery 31, and a control panel 32. The control panel 32 includes a power block and fuse panel which has an input terminal connected to the battery 31, and multiple output terminals some of which are connected to the pump 22, the heater 30, equipment enclosure lights 33, a clearance light switch 34, and a spotlight 37. The control panel 32 has a master power switch 35 which couples and decouples the battery 31 to the output terminals, and a timer switch 36 for the heater 36. The battery 31 in this embodiment is rechargeable and has input terminals for connecting to a battery charger (not shown).

The pump 22, heater 30, and battery 31 can be obtained from commercially available sources. For example, a suitable heater is the Tandem 717 by Webasto that can be powered by the battery 31 or optionally by diesel fuel from an on board fuel tank (not shown), and a suitable battery can be a Caterpillar 4D 12 V battery with a two stage charging platform, in which case the pump 20 can be a 12 V hydraulic pump.

The heater 30 operation can be controlled by the timer 36 or by a thermostat in the heater 30. The heater 30 can be operated to keep the other equipment and especially the oil in the containers 24 at a suitable operating temperature. The pump 22 includes a pressure gauge 40 and a relief valve 42 at the pump outlet.

Figure 2:
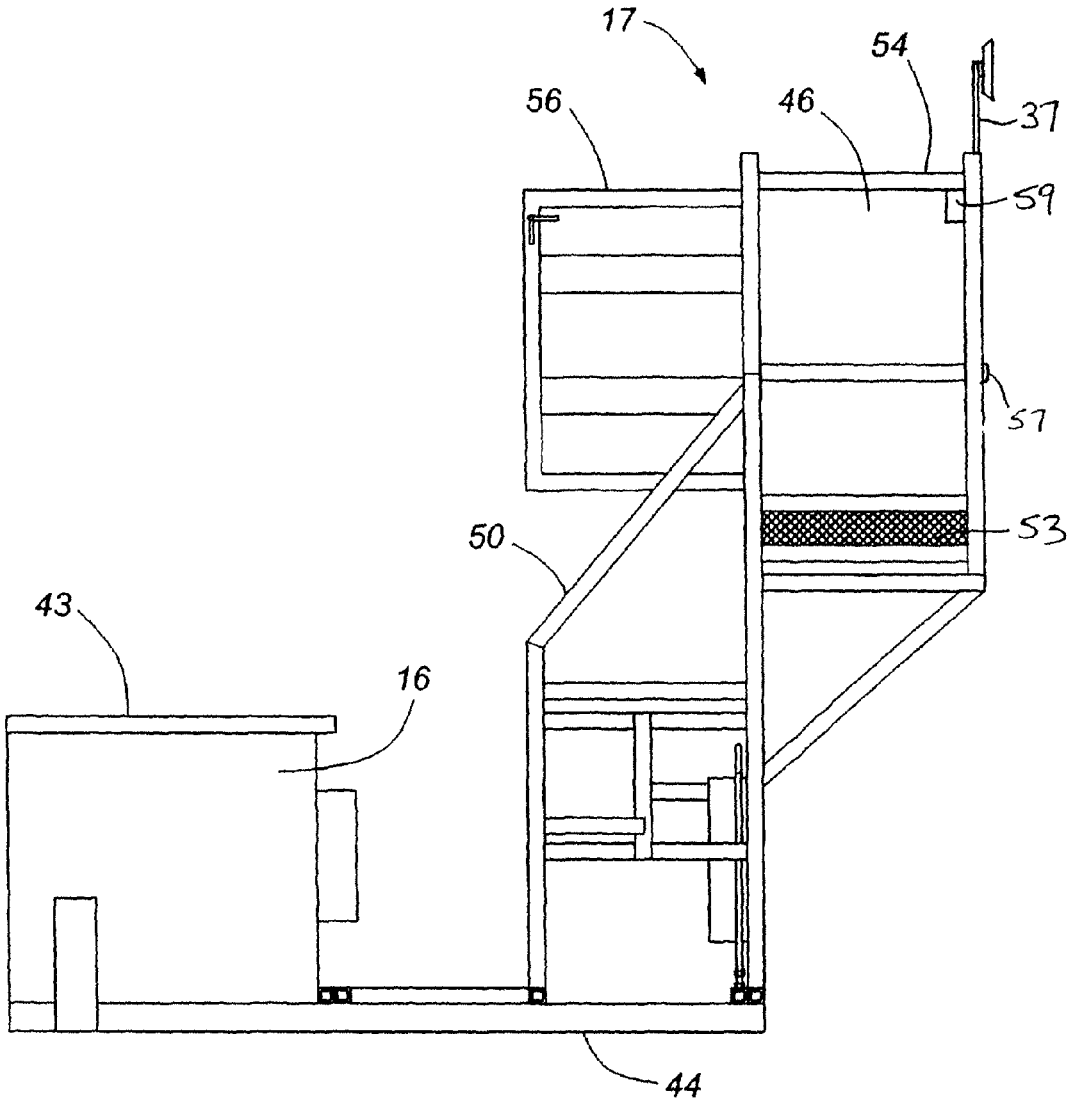
FIG. 2 is a side elevation view of a platform of the spray apparatus.
Figure 3:
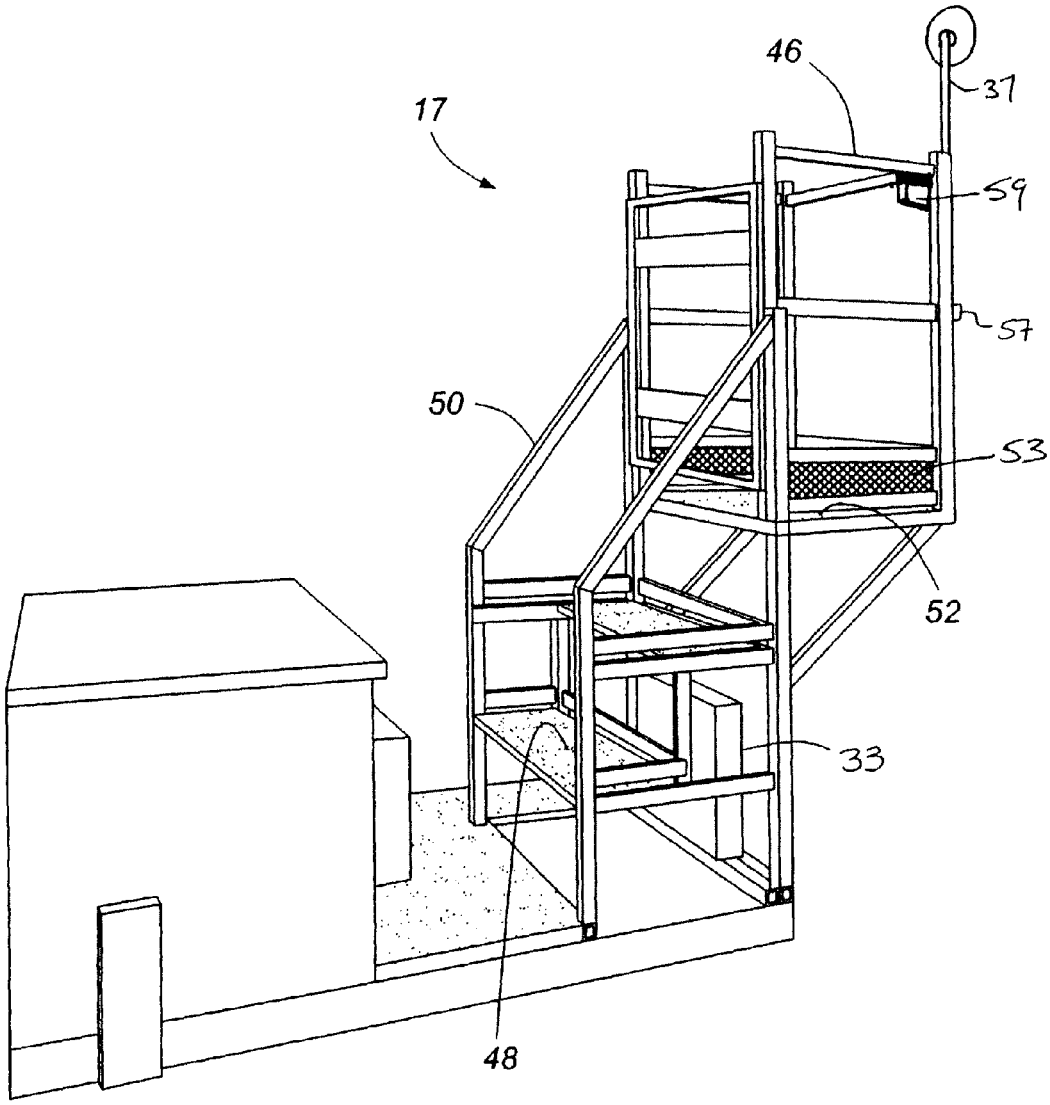
FIG. 3 is a perspective view of the platform.

Referring now to FIGS. 2 and 3, the spray equipment is housed inside the equipment enclosure 16 which in this embodiment is a metal box with a hinged top cover 43. The equipment enclosure 16 can be lined with thermal insulation material to assist in retaining heat from the heater 30 inside the enclosure 16. The equipment enclosure 16 is mounted to a front end of a platform base 44, which is comprised of metal tubing, flat bars and angles covered by metal granting to support the operator. The base 44 comprises load binders (not shown) which are attachable to factory hooks in the box of the pick-up truck A, as well as mounting stakes (not shown) extending downwards from the base 44 to engage the pick-up truck bed surface.

The elevated section 17 of the platform 12 is mounted to the rear of the platform base 44 and comprises an elevated operator box 46, and stairs 48 and railing 50 interconnecting the platform base 44 to the operator box 46. The operator box has a metal grating base 52, foot grille 53, railing 54, and a swing gate 56 at the top of the stairs 48. A switch (not shown) for controlling the hydraulic pump 22 is located on the operator box to enable the operator to conveniently operate the pump 22 during a spray operation. Clearance lights 57 are mounted at the rearward end of the operator box and electrically coupled to the clearance light switch 34. The spot light 37 and a horn 59 are also mounted on the rearward end of the operator box.

The elevated section 17 of the platform 12 allows the operator to operate the spray wand 18 to spray a surface from an elevated position; as can be seen in FIG. 1, the operator is shown in dotted line standing on the elevated section 18 and is aiming the spray wand 18 into the dump truck bed. The spray wand has a trigger which is coupled to a flow valve that is opened and closed by operation of the trigger, thereby controlling the flow of the vegetable oil from the spray gun.

While the operator box 46 is shown elevated at a height that is suitable for an operator to spray over a top edge of a dump truck box (when the apparatus 10 is mounted to a pick-up truck), the apparatus 10 can be modified with a higher or lower operator box 46 depending on the specific application. Alternatively, in certain low elevation applications such as spraying the surfaces of an excavator bucket, the operator can simply stand on the platform base 44 or on the ground instead of in the operator box.

The method of operating the apparatus 10 is now described. The operator turns the master switch 35 to "ON". As well, the clearance light switch 34 is turned to "ON" which activates the clearance lights thereby making the apparatus 10 more visible during operation. The apparatus 10 is then moved into a suitable position for spraying the intended surface; for example, when the apparatus 10 is mounted on a pick-up truck and is used to spray a dump truck box, the apparatus 10 can be maneuvered into place by the pick-up truck into a position beside the dump truck box. Alternatively, the apparatus 10 can be kept stationary and the dump truck is maneuvered into place beside the operator box of the apparatus 10.

If the ambient temperature is too cold for proper flow of the vegetable oil, the operator also turns on the heater 30. Typically the oils are heated to a temperature of about 18° C. but can be increased to up to 35° C. under extreme temperatures. When the vegetable oil is at a suitable operating temperature, the operator holding the spray wand 18 can climb the stairs 38 and enter the operator box 46. The operator turns the pump switch to "ON" to activate the hydraulic pump 22, aims the spray wand 18 into the bed of the dump truck box and pulls the trigger to release the vegetable oil. Spray operation continues until the bed is fully coated with the vegetable oil. The operator can if necessary apply multiple coatings of the vegetable oil onto the bed.

In a typical application, the operator will spray using a 5" to 10" spray pattern and can coat about ten truck/trailer unit boxes per five gallon pail of oil. A truck box bed is coated each time a load is hauled. The type of oil used will depend on a number of factors including the price of each oil type, the type of material being hauled, and the outside temperature and other environmental conditions. The spraying technique can also be affected by these factors. For example, during extremely cold temperatures or when handling extremely wet materials, the operator will select an oil with thicker viscosity and may apply multiple coatings to the dump truck bed.

As the operator is spraying the vegetable oil using a relatively high pressure, it is expected that a surface like a bed of a dump truck box can be coated within a few minutes. Compared to conventional techniques like applying a polymer lining or straw layer onto the bed, the vegetable oil spraying method of the present embodiment is much faster, more environmentally friendly, and less messy.

Figure 6:
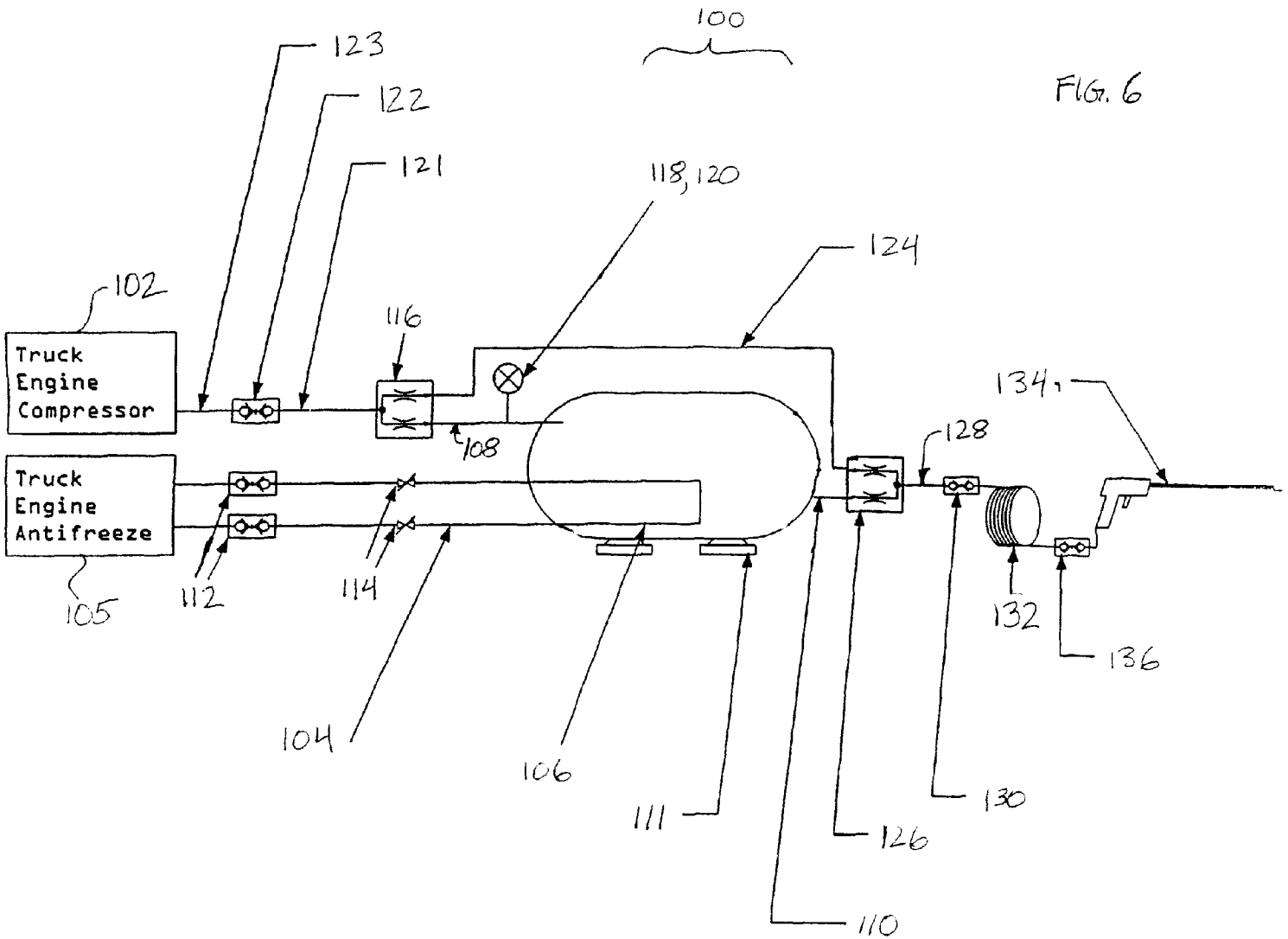
FIG. 6 is a schematic view of components of a spray apparatus according to a second embodiment of the invention.

According to a second embodiment and referring to FIG. 6, a spray apparatus 100 is provided which utilizes an air compressor 102 instead of the hydraulic pump 22 of the first embodiment, and an oil reservoir pressure tank 106 in thermal contact with an anti-freeze conduit 104 instead of the space heater 30 of the first embodiment. The air compressor 102 can conveniently be an existing truck engine compressor, and the anti-freeze conduit 104 can be fluidly coupled to an existing truck anti-freeze tank 105 to circulate the truck's anti-freeze through the conduit 104. This arrangement enables the apparatus 100 to utilize existing truck components and thus permit a more compact design. For a particularly compact design (not shown), this embodiment of the apparatus 10 can also forgo the elevated section 17 of the platform 12 used in the first embodiment. In this particularly compact embodiment, the operator could use a ladder or other means for elevating himself or herself to a suitable height to spray a truck bed or other material handling surface. Or, this particularly compact embodiment would be useful where it is not necessary to be in an elevated position to spray a material handling surface, e.g. a loader bucket.

In the second embodiment, the reservoir pressure tank 106 serves to hold the oil used to spray the material surface. The pressure tank 106 has a pair of openings to receive the anti-freeze conduit 104. Although the anti-freeze conduit 104 is shown as a simple U-shaped loop inside the reservoir pressure tank 106 in FIG. 6, the anti-freeze conduit 104 can have a pathway that improves the heat exchange between the anti-freeze flowing through the conduit 104 and the oil in the pressure tank 106, e.g. a serpentine pattern (not shown). The pressure tank 106 has another pair of openings, namely an air inlet that couples to an air feed conduit 108 and an oil outlet that couples to an oil discharge conduit 110. The pressure tank 106 also has an oil fill opening with sealing cap (not shown) to allow an operator to fill the pressure tank with oil from time to time.

The pressure tank 106 also has a set of mounting brackets 111 which can be used to secure the pressure tank to a platform (not shown) of the apparatus 100, or directly to a convenient location on a truck such as the truck bed (not shown).

The anti-freeze conduit 104 can be a metal pipe insert, such as a ⅝" pipe insert that is commonly available. An inlet end and outlet end of the anti-freeze conduit 104 are fluidly coupled by respective fluid couplers 112 to a respective outlet and inlet of the truck's anti-freeze reservoir tank 105. A pair of two way valves 114 can be each fluidly coupled to the anti-freeze conduit 104 near the inlet and outlet ends to control the flow of anti-freeze in and out of the pressure tank 106. A control thermostat 115 is provided to regulate the flow of anti-freeze into the pressure tank 106 based on a selected temperature; the thermostat includes a control valve fluidly coupled to the anti-freeze conduit 104 a temperature sensor in thermal communication with anti-freeze flowing through the conduit 104, and a temperature selector. The control valve setting is controlled based on the measured temperature and the selected temperature setting, e.g. the control valve can be configured to close flow through the anti-freeze conduit 104 when the measured anti-freeze temperature exceeds a selected safe temperature.

The air feed conduit 108 can be a pipe and is coupled to one of two outlets of a three way air inlet control valve 116. A pressure regulator 118 and pressure gauge 120 are fluidly coupled to the air feed conduit 108 to respectively control the flow of air into the pressure tank 106 and measure the air pressure in the pressure tank 106. An inlet of the air inlet control valve 116 is coupled to one end of an inlet airline 121 having at its other end an air coupler 122 for coupling to an air hose 123 of the truck engine air compressor 102.

The other outlet of the air inlet control valve 116 is coupled to one end of an air bypass line 124 which is coupled at its other end to one of two inlets of a three way air outlet control valve 126; the other inlet of the air outlet control valve 126 is fluidly coupled to the oil outlet of the pressure tank 106 by the oil discharge conduit 110. An outlet of the air outlet control valve 126 is coupled to a mixed flow conduit 128 which has a fluid coupler 130 for coupling to an inlet end of a flexible hose 132. The flexible hose has an outlet end which is coupled to a spray wand 134 by another fluid coupler 136. The spray wand 134 can be of the same design as described in the first embodiment.

In operation, the pressure regulator can be set at a suitable pressure such as 60 lbs, and the truck air compressor 102 and a truck's water pump (not shown) coupled to the antifreeze tank 105 are turned on. Air is flowed into the pressure tank 106 by setting the air inlet control valve 116 accordingly. Anti-freeze is circulated through the pressure tank 106 by opening the pair of two way valves 114. The anti-freeze should be circulated at a rate that keeps the oil in the pressure tank 106 from freezing.

Once the pressure tank 106 has been sufficiently pressurized to discharge oil from the spray wand 134 at a desirable pressure, the air inlet and air outlet control valves 116, 126 are set to flow air and oil respectively to the air outlet control valve 126 where the air and oil mix; this air and oil mixture then flows through the flexible hose 132 to the spray gun 134 for discharge by the operator.

While particular embodiments have been described in this description, it is to be understood that other embodiments are possible and that the invention is not limited to the described embodiments and instead are defined by the claims.

What is claimed is:

1. An apparatus configured to spray an oil onto a material handling surface consisting of a truck bed and a trailer bed to impede material from adhering to the surface, comprising:

a platform comprising an elevated section configured to support a human operator;

a vegetable oil selected from the group consisting of oils that are exempt from listing in a workplace hazardous material safety data sheet; and spray equipment comprising:

a container for containing the vegetable oil;

a hydraulic pump fluidly coupled to the container; and a spray wand and hose assembly fluidly coupled to the hydraulic pump;

wherein the spray equipment is mounted on the platform and configured to enable an operator to operate the spray wand from the elevated section of the platform.

2. The apparatus as claimed in claim 1, wherein the vegetable oil is selected from the group consisting of sunflower oil, Mazola oil, flax oil, olive oil, coconut oil, corn oil, soy oil, safflower oil, and canola oil.

3. The apparatus as claimed in claim 1, wherein the platform comprises a base section and an equipment enclosure mounted on the base section and enclosing the spray equipment.

4. The apparatus as claimed in claim 3, wherein the base section comprises means for coupling to a bed of pick-up truck.

5. The apparatus as claimed in claim 3, wherein the spray equipment further comprises an electric heater for heating the interior of the equipment enclosure.

6. The apparatus as claimed in claim 5, wherein the spray equipment further comprises a control panel having a power block and fuse panel with a power input terminal and multiple power output terminals at least some of which are coupled to the electric heater and the hydraulic pump.

7. The apparatus as claimed in claim 6, wherein the spray equipment further comprises a battery electrically coupled to the power input terminal.

8. The apparatus as claimed in claim 6, wherein the elevated section comprises an operator box suitable for supporting a human operator and located at a height which enables an operator to spray over a top edge of a dump truck box when the apparatus is mounted in a pick-up truck bed.

9. The apparatus as claimed in claim 8, wherein the operator box comprises clearance lights electrically coupled to the control panel.

10. The apparatus as claimed in claim 8, wherein the operator box comprises a pump actuation switch coupled to the pump.

11. An apparatus configured to spray an oil onto a material handling surface consisting of a truck bed and a trailer bed to impede material from adhering to the surface comprising:

a vegetable oil selected from the group consisting of oils that are exempt from listing in a workplace hazardous material safety data sheet;

an oil reservoir pressure tank for containing the vegetable oil;

an anti-freeze conduit extending inside the oil reservoir pressure tank and thermally communicable with vegetable oil in the oil reservoir pressure tank, the anti-freeze conduit fluidly coupled to an antifreeze source;

an air feed conduit fluidly coupled to an air inlet of the oil reservoir pressure tank and fluidly coupled to an air compressor; and a spray wand and hose assembly fluidly coupled to an oil outlet of the pressure tank and the air compressor.

12. An apparatus as claimed in claim 11 further comprising a pressure regulator and pressure gauge fluidly coupled to the air feed conduit.

13. An apparatus as claimed in claim 11 further comprising a three way air inlet control valve and a three way air outlet control valve, and an air bypass line coupling a first outlet of the air inlet control valve to a first inlet of the air outlet control valve, and wherein a second outlet of the air inlet control valve is coupled to the air feed conduit, and an inlet of the air inlet control valve is fluidly coupled to the air compressor, and wherein a second inlet of the air outlet control valve is coupled to the oil outlet of the oil reservoir pressure tank, and an outlet of the air outlet control valve is fluidly coupled to the spray wand and hose assembly.

14. An apparatus as claimed in claim 11, wherein the oil reservoir pressure tank comprises mounting brackets for mounting the oil reservoir pressure tank to a motor vehicle, and the air compressor is an air compressor of the motor vehicle, and the anti-freeze source is an anti-freeze tank of the motor vehicle.

15. An apparatus as claimed in claim 11, wherein the vegetable oil is selected from the group consisting of sunflower oil, Mazola oil, flax oil, olive oil, coconut oil, corn oil, soy oil, safflower oil, and canola oil.

16. An apparatus as claimed in claim 11 further comprising a control thermostat including a control valve fluidly coupled to the anti-freeze conduit and configured to control the flow of anti-freeze into the oil reservoir pressure tank as a function of a selected temperature.

17. A system configured to spray vegetable oil onto a material handling surface consisting of a truck bed and a trailer bed to impede material from adhering to the surface, comprising:

a platform comprising an elevated section configured to support a human operator; and spray equipment comprising:

a vegetable oil container;

a hydraulic pump fluidly coupled to the vegetable oil container; and a spray wand and hose assembly fluidly coupled to the hydraulic pump;

wherein the spray equipment is mounted on the platform and enables an operator to operate the spray wand from the elevated section of the platform.

18. The system as claimed in claim 17, wherein the vegetable oil container contains a vegetable oil selected from the group consisting of oils that are exempt from listing in a workplace hazardous material safety data sheet.

* * * * *